US005715777A

United States Patent [19]

Wada et al.

[11] Patent Number: 5,715,777

[45] Date of Patent: Feb. 10, 1998

[54] ENGINE FOR OUTBOARD ENGINE SYSTEM

[75] Inventors: Tetsu Wada; Hiroyuki Murata; Masaki Tsunoda, all of Wako, Japan

[73] Assignee: Honda Giken Kogyo Kabushiki Kaisha, Tokyo, Japan

[21] Appl. No.: 638,932

[22] Filed: Apr. 25, 1996

[30] Foreign Application Priority Data

Apr. 28, 1995 [JP] Japan ..... 7-105439
May 18, 1995 [JP] Japan ..... 7-120139

[51] Int. Cl.[6] ..... F01P 7/14

[52] U.S. Cl. ..... 123/41.09; 123/195 P; 440/88; 440/900

[58] Field of Search ..... 123/41.08, 41.09, 123/195 P; 440/88, 900

[56] References Cited

U.S. PATENT DOCUMENTS 2,471,533 5/1949 Morgan ..... 123/41.08

FOREIGN PATENT DOCUMENTS 57-68120 4/1982 Japan .
62-218299 9/1987 Japan .
3-37322 2/1991 Japan .
8-100658 4/1996 Japan .

*Primary Examiner*—Noah P. Kamen
*Attorney, Agent, or Firm*—Nikaido, Marmelstein, Murray & Oram LLP

[57] ABSTRACT

Cooling water pumped by a cooling-water pump is passed via a cooling-water supply passage, a cooling-water dispensing chamber, two upper and lower through-holes and a water jacket, a thermo-valve and discharged via a cooling-water discharge passage. When the amount of cooling water supplied from the cooling-water pump is excessive, or when the thermo-valve has been closed, a relief valve mounted in a bypass passage which connects the cooling-water supply passage and the cooling-water discharge passage is opened, thereby permitting the cooling water to be diverted. The bypass passage diverges from the cooling-water supply passage upstream of the cooling-water dispensing chamber. Therefore, even if the relief valve is opened, the flow pattern of the cooling water flowing within the cooling-water dispensing chamber is not influenced, and the flow rates of the cooling water passed through the two through-holes cannot be unbalanced.

6 Claims, 15 Drawing Sheets

ENGINE FOR OUTBOARD ENGINE SYSTEM

BACKGROUND OF THE INVENTION

1. Field of the Invention

The present invention relates to an engine for an outboard engine system including a relief valve for controlling the amount of cooling water supplied to a water jacket.

2. Description of the Related Art

There is a conventional known engine for an outboard engine system, which has been proposed by the present assignee (see Japanese Patent Application Laid-open No. 100658/96. This engine includes a cooling-water passage with its supply and discharge portions communicating with a relief valve, so that when the pressure of cooling water supplied is increased the relief valve is opened, thereby permitting a portion of the cooling water to be discharged without being supplied.

In the above known engine, a cooling-water dispensing chamber, to which the cooling water is supplied from a cooling-water supply passage, is provided in a side of a cylinder block, so that the cooling water is supplied from the cooling-water dispensing chamber through a plurality of through-holes to water jackets of the cylinder block and a cylinder head. The relief valve is mounted in a bypass passage which connects an intermediate portion of the cooling-water dispensing chamber and a cooling-water discharge passage to each other.

In the known engine, one or some of the plurality of through-holes provided in the cooling-water dispensing chamber are disposed at upstream locations near the cooling-water supply passage. The remaining one or some are disposed at locations remote from the cooling-water supply passage. Therefore, when the relief valve is opened, there is a possibility that the amount of the cooling water supplied through the through-holes located more upstream of a junction with the bypass passage to the water jackets of the cylinder block and the cylinder head is little decreased, while the amount of the cooling water supplied through the through-holes located downstream of the junction with the bypass passage to the water jackets is largely decreased. As a result, the cooling effect for the cylinder block and the cylinder head is partially unbalanced.

In an engine for a boat used on the sea, sea-water is used as cooling water and hence, it is necessary to wash away salts. In addition, even in a fresh water area such as lake, swamp and the like, it is necessary to wash away mud and fine dirt. For this reason, wash water is injected into the water jackets to perform the washing. Examples of such water jacket washing devices which have been conventionally know are a washing device in an outboard engine system, which is described as a second embodiment in Japanese Utility Model Application Laid-open No.68120/82, and a washing device in an outboard engine system, which is described in Japanese Patent Application laid-open No.37322/91. Other examples are a washing device in a small-sized boat, which is described as a first embodiment in Japanese Utility Model Application Laid-open No.68120/82, and a washing device in a small-sized boat, which is described in Japanese Patent Application laid-open No.218299/87. The washing device described as the second embodiment in Japanese Utility Model Application Laid-open No.68120/82 and the washing device described in Japanese Patent Application laid-open No.37322/91 have certain disadvantages. The operation of a cooling-water pump is not required, as compared with a washing system in which wash water is injected from a lower portion of an outboard engine system body. The washing can be carried out even in a condition in which the outboard engine system has been mounted on a boat floating on the water.

In an outboard engine system including a thermo-valve for promoting the warming of the engine mounted in a cooling-water passage supplied with cooling water from a cooling-water pump as in the outboard engine system described in Japanese Patent Application laid-open No.37322/91, the wash water is supplied into a passage closed by a cooling-water pump and the thermo-valve. However, such outboard engine system suffers from a problem that if a pressure of tap water sufficient against the biasing force of a valve spring for biasing the thermo-valve in a closing direction when at a cold temperature is not obtained, only a small amount of the wash water flows corresponding to the amount of wash water leaked at each portion. Consequently, a sufficient washing effect is not obtained. Such outboard engine system also has another problem that a wash water supply section connecting a hose for supplying the wash water is exposed to the outside of the outboard engine system, resulting in a degraded appearance of the outboard engine system.

SUMMARY OF THE INVENTION

Accordingly, it is a first object of the present invention to uniformly supply the wash water to the water jackets even during opening of the relief valve.

It is a second object of the present invention to ensure that an engine for an outboard engine system including a thermo-valve can be easily washed even with tap water of a relatively low pressure, and to prevent a degradation of the appearance due to exposition of the wash water supply section to the outside.

To achieve the first object, according to the present invention, there is provided an engine for an outboard engine system comprising certain structure. A first water jacket is provided in the cylinder block. A second water jacket is provided in a cylinder head. A cooling-water dispensing chamber dispenses cooling water to the first and second water jackets through a plurality of through-holes. A cooling-water supply passage supplies the cooling water into the cooling-water dispensing chamber. A cooling-water discharge passage is provided into which the cooling water passed through the first and second water jackets flows. A bypass passage connects the cooling-water supply passage and the cooling-water discharge passage. A relief valve opens and closes the bypass passage.

With the above arrangement, the cooling-water supply passage and the cooling-water discharge passage are connected to each other by the bypass passage provided with the relief valve which is opened when the pressure of cooling water supplied exceeds a predetermined value. Therefore, even if the relief valve is opened, a flow pattern of the cooling water flowing within the cooling-water dispensing chamber located downstream of the cooling-water supply passage cannot be partially changed. Thus, the amount of the cooling water supplied from the cooling-water dispensing chamber through the plurality of through-holes to the first and second water jackets cannot be unbalanced.

To achieve the second object, according to the present invention, there is provided an engine for an outboard engine system comprising certain structure. A water jacket is provided in an engine block. A first cooling-water passage is connected to the water jacket at a location upstream in a direction of flowing of the cooling water. A second cooling-water passage is connected to the water jacket at a location downstream in the direction of flowing of the cooling water. A cooling-water pump supplies the cooling water to the first cooling-water passage. A thermo-valve is mounted in the second cooling-water passage. A bypass passage connects the first cooling-water passage to the second cooling-water passage at a location more downstream in the direction of flowing of the cooling water than the thermo-valve. A relief valve is mounted in the bypass passage for permitting the cooling water to bypass from the first cooling-water passage to the second cooling-water passage. A wash water introducing section is provided in the second cooling-water passage between the water jacket and the thermo-valve.

With the above arrangement, the wash water supplied from the wash water introducing section to the second cooling-water passage can be passed through the inside of the water jacket, and the wash water which has washed the water jacket can be discharged through the relief valve mounted in the bypass passage. Moreover, even if the thermo-valve is not forcedly opened by the pressure of the water, a sufficient amount of the wash water more than the amount of wash water leaked from the thermo-valve can be supplied in a relatively short time. Accordingly, the water jacket can be easily washed by tap water having a low pressure, leading to an enhanced convenience. Additionally, it is unnecessary to set the pressure for opening the thermo-valve at a low level for the washing purpose. Therefore, it is possible to provide a reduction in size of the thermo-valve.

In addition to the above arrangement, if a one-way valve is mounted in the wash water introducing section for limiting the flowing-out of the cooling water from the wash water introducing section, it is possible to prevent the leakage of the cooling water from the wash water introducing section during operation of the engine, while permitting the supplying of the wash water from the wash water supply section.

In addition, if the wash water introducing section is provided in a ridge formed in the engine block, the wash water introducing section can be mounted without influencing the layout of the water jacket and the second cooling-water passage within the engine block.

Further, the engine can further include other structure. A body case is provided for supporting the engine on an upper surface of the body case. A lower case is fixed to the body case to cover a lower half of the engine. An upper cover is detachably fixed to an upper edge of the lower case to cover an upper half of the engine. A lower cover is bolted to a lower edge of the lower case, and extends downwardly from the lower edge and is connected to an outer surface of the body case. A wash water supply section is provided in the lower case and covered with the lower cover. A wash water supply passage is disposed within the upper cover and lower case and connects the wash water supply section and the wash water introducing section to each other. A lid which is capable of opening and closing is mounted to the lower cover opposed to the wash water supply section. Thus, it is possible to wash the water jacket by removing only the smaller-sized lid in place of removing the larger-size upper cover, thereby providing not only an enhanced workability, but also enabling the wash water to be supplied to the wash water supply section without hindrance, while ensuring that the wash water supply section is incapable of being viewed from the outside to provide an enhanced appearance.

The above and other objects, features and advantages of the invention will become apparent from the following detailed description of preferred embodiments taken in conjunction with the accompanying drawings.

DETAILED DESCRIPTION OF THE PREFERRED EMBODIMENTS

A first embodiment of the present invention will now be described with reference to FIGS. 1 to 12.

Figure 1:
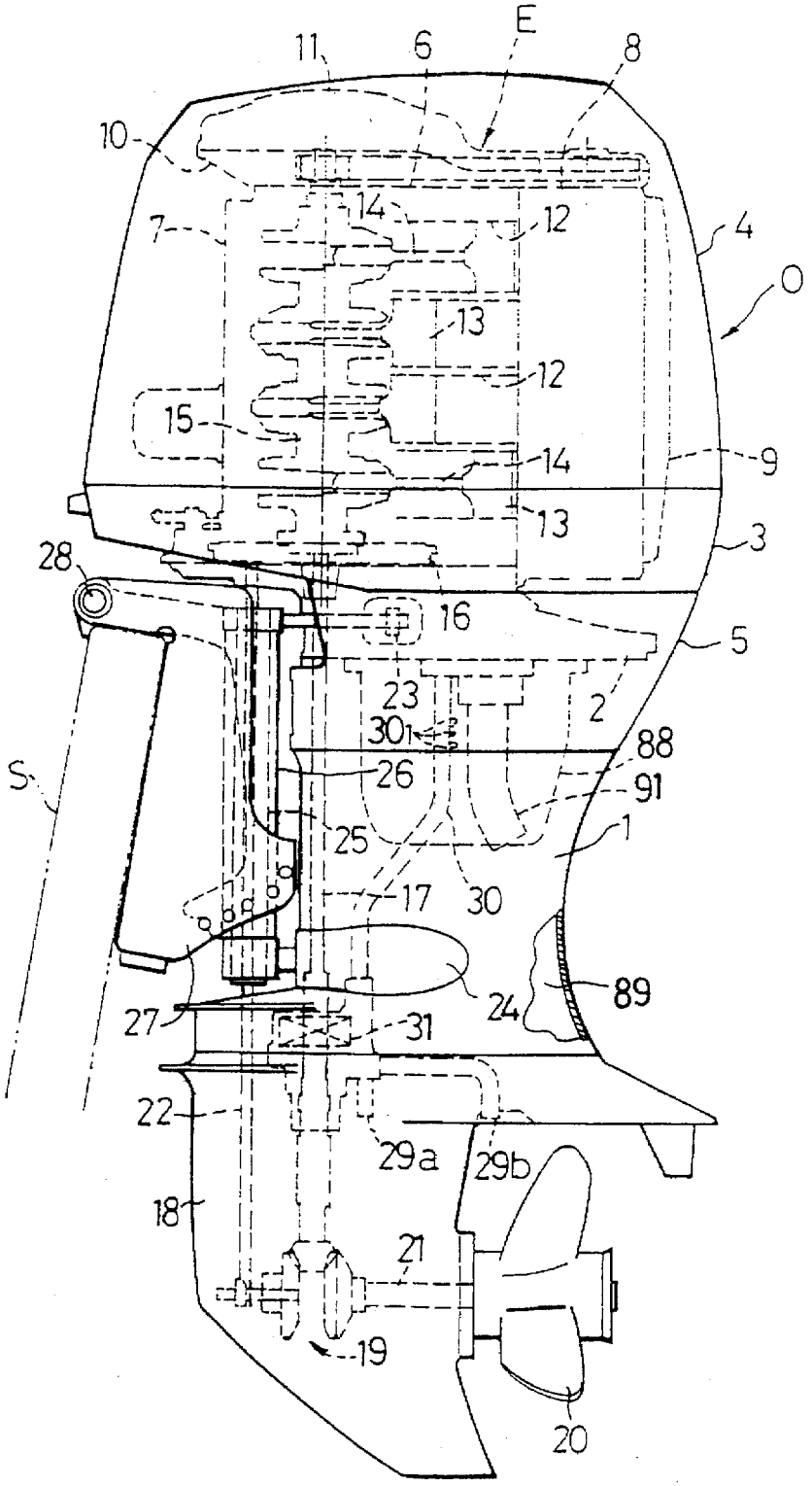
FIG. 1 is a side view of the entire arrangement of an outboard engine system including an engine according to a first embodiment of the present invention.

Referring to FIG. 1, an outboard engine system O includes a mount case 2 coupled to an upper portion of an extension case 1. A serial four-cylinder and four-cycle engine E is supported on an upper surface of the mount case 2. An under-case 3 having an upper surface opened is coupled to the mount case 2. An engine cover 4 is detachably mounted to an upper portion of the under-case 3. An under-cover 5 is mounted between a lower edge of the under-case 3 and an upper edge of the extension case 1 to cover an exterior of the mount case 2.

The engine E includes a cylinder block 6, a crankcase 7, a cylinder head 8, a head cover 9, a lower belt cover 10 and an upper belt cover 11. The cylinder block 6 and the crankcase 7 are supported on an upper surface of the mount case 2. The cylinder block 6 and the cylinder head 8 constitute a body case according to the present invention.

A piston 13 is slidably received in each of four cylinders 12 formed in the cylinder block 6. Each of the pistons 13 is connected to a vertically disposed crankshaft 15 through corresponding one of the connecting rods 14.

A driving shaft 17 is connected along with a flywheel 16 to a lower end of the crankshaft 15, and extends downwardly within the extension case 1. A lower end of the driving shaft 17 is connected to a propeller shaft 21 having a propeller 20 at its rear end through a shaft gear mechanism 19 which is mounted within a gear case 18. A shift rod 22 is connected at its lower end to a front portion of the shift gear mechanism 19 to change the rotational direction of the propeller shaft 21.

A cooling-water pump 31 is mounted on the driving shaft 17 and incorporated in an intermediate portion of a cooling-water supply pipe 30. The cooling-water supply pipe 30 extends upwardly from two cooling-water intake ports 29*a* and 29*b* opens into the water and is connected to a lower surface of the mount case 2. Alternatively, one of the two cooling-water intake ports 29*a* and 29*b* may be omitted. The cooling-water pump 31 is comprised of, for example, a vane pump.

Figure 2:
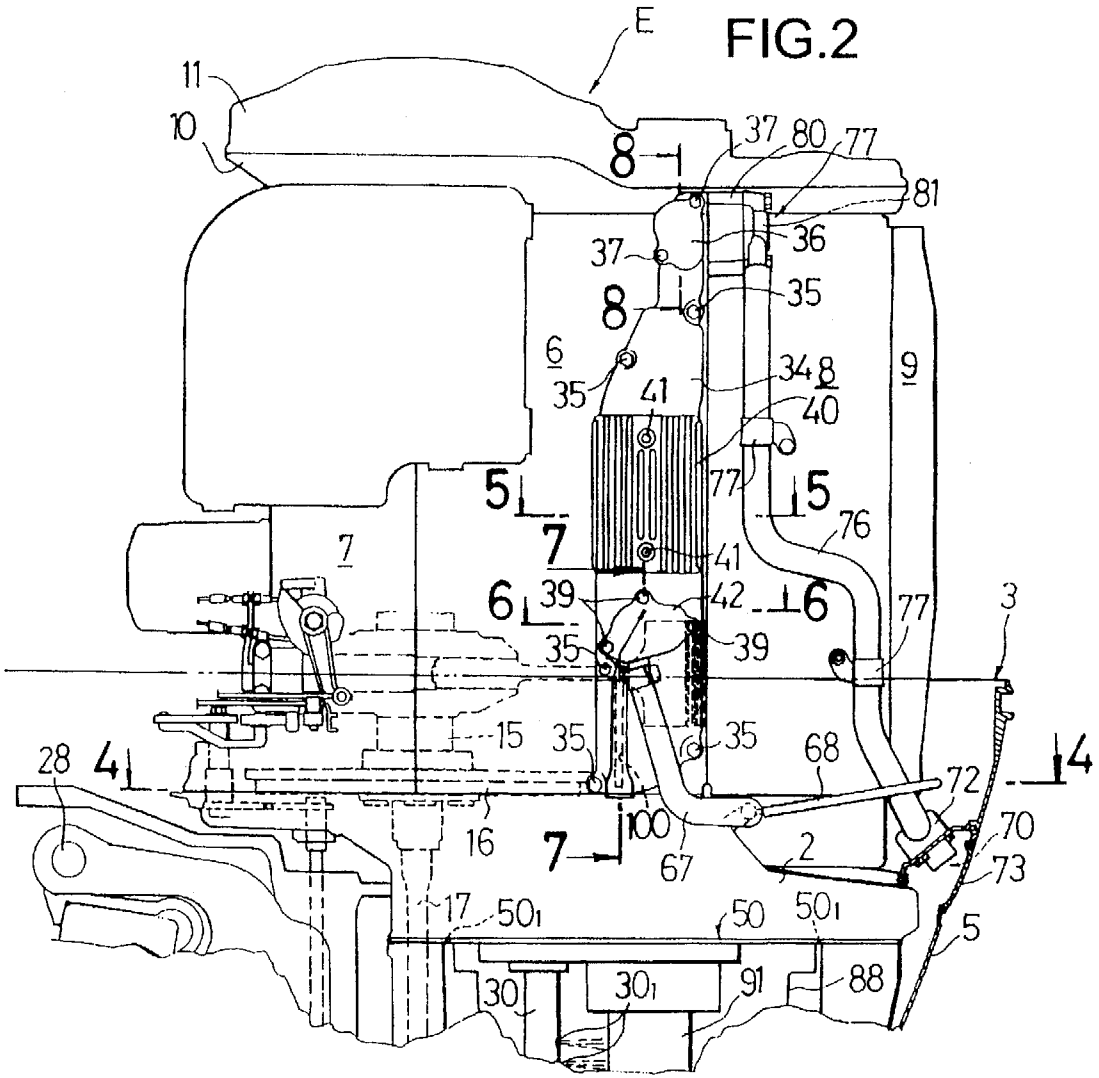
FIG. 2 is a left side view of the engine.

A plurality of small holes $\mathbf{30}_1$ are made in the cooling-water supply pipe 30, so that an exhaust pipe 91 is cooled by cooling water ejected from the small holes $\mathbf{30}_1$ to the exhaust pipe 91 (see FIG. 2).

A swivel shaft 25 is fixed between an upper mount 23 provided in the mount case 2 and a lower mount 24 provided in the extension case 1. The swivel shaft 25 is rotatably supported, whereby a swivel case 26, which enables the outboard engine system O to be steered, is vertically swingably supported on a stern bracket 27 mounted at a stern S through a tilting shaft 28.

A cooling system of the engine E will be described below with reference to FIGS. 2 to 8.

Figure 5:
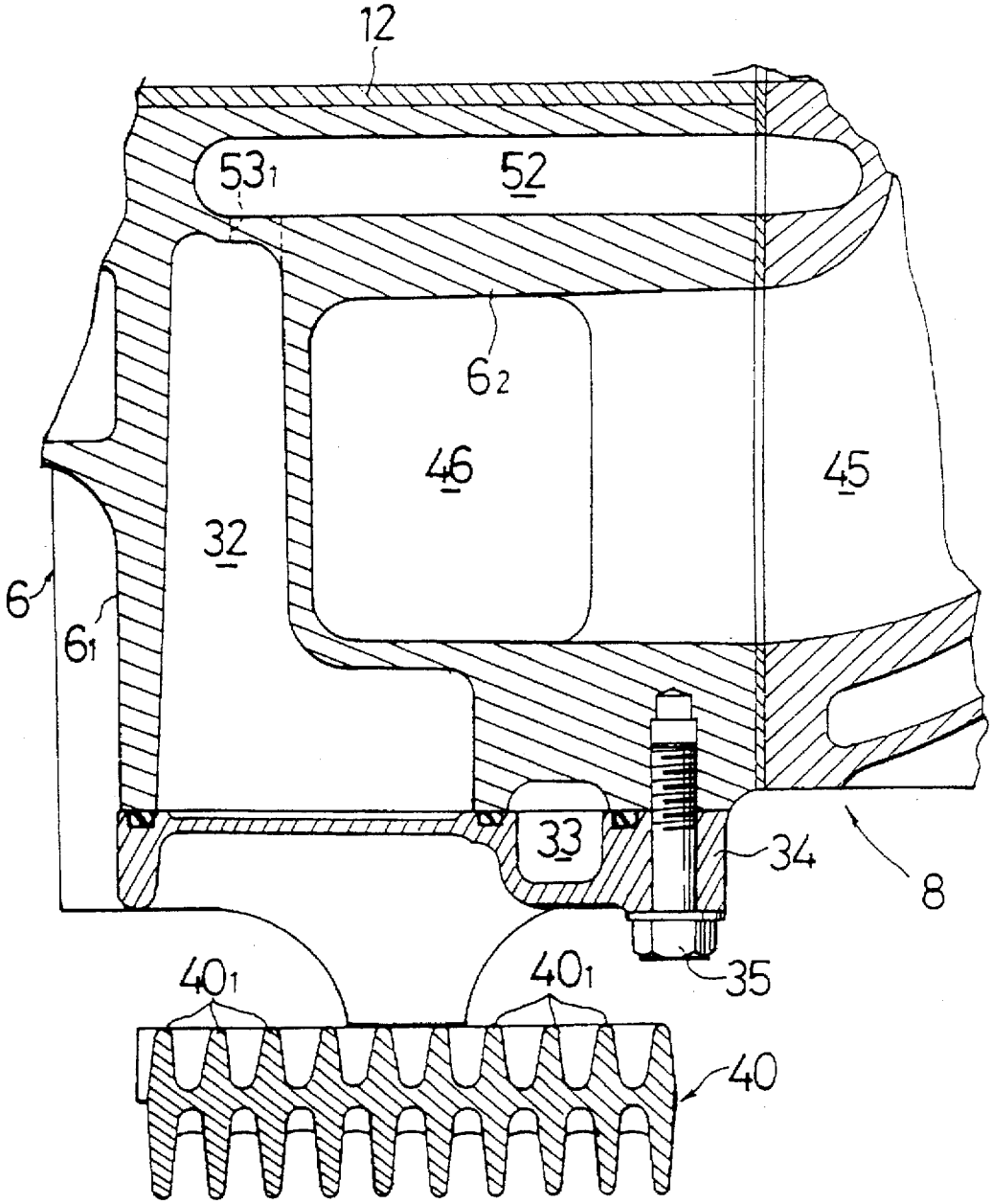
FIG. 5 is an enlarged sectional view taken along a line 5—5 in FIG. 2.

An exhaust passage 46 which will be described hereinafter is formed in a protrusion $\mathbf{6}_1$ which is provided on a left side of the cylinder block 6 of the engine E to extend away from the cylinders 12. Further, a cooling-water passage cover 34 is fixed to the protrusion $\mathbf{6}_1$ by a plurality of bolts 35, thereby forming a cooling-water dispensing chamber 32 and a cooling-water discharging passage 33 which will be described hereinafter. In FIG. 5, reference character $\mathbf{6}_2$ is a wall face of the cylinder block 6, which adjoins a first water jacket 52 and the exhaust passage 46 downstream of the cooling-water dispensing chamber 32.

A thermo-valve cover 36 is fixed to an upper end of the cooling-water passage cover 34 by two bolts 37, 37. A relief valve housing 38 and a relief valve cover 42 are fixed at locations below and near a central portion of the cooling-water passage cover 34 by three bolts 39. A regulator rectifier 40 having a large number of radiation fins $\mathbf{40}_1$ is fixed between the thermo-valve cover 36 and the relief valve cover 42 by two bolts 41.

As can be seen from FIG. 2, the three bolts 39 fixing the relief valve cover 42 are located above an upper end of the under-case 3. The two bolts 37 fixing the thermo-valve cover 36 are located further above the bolts 39. Therefore, it is possible to remove the relief valve cover 42 and the thermo-valve cover to easily perform maintenance.

Figure 3:
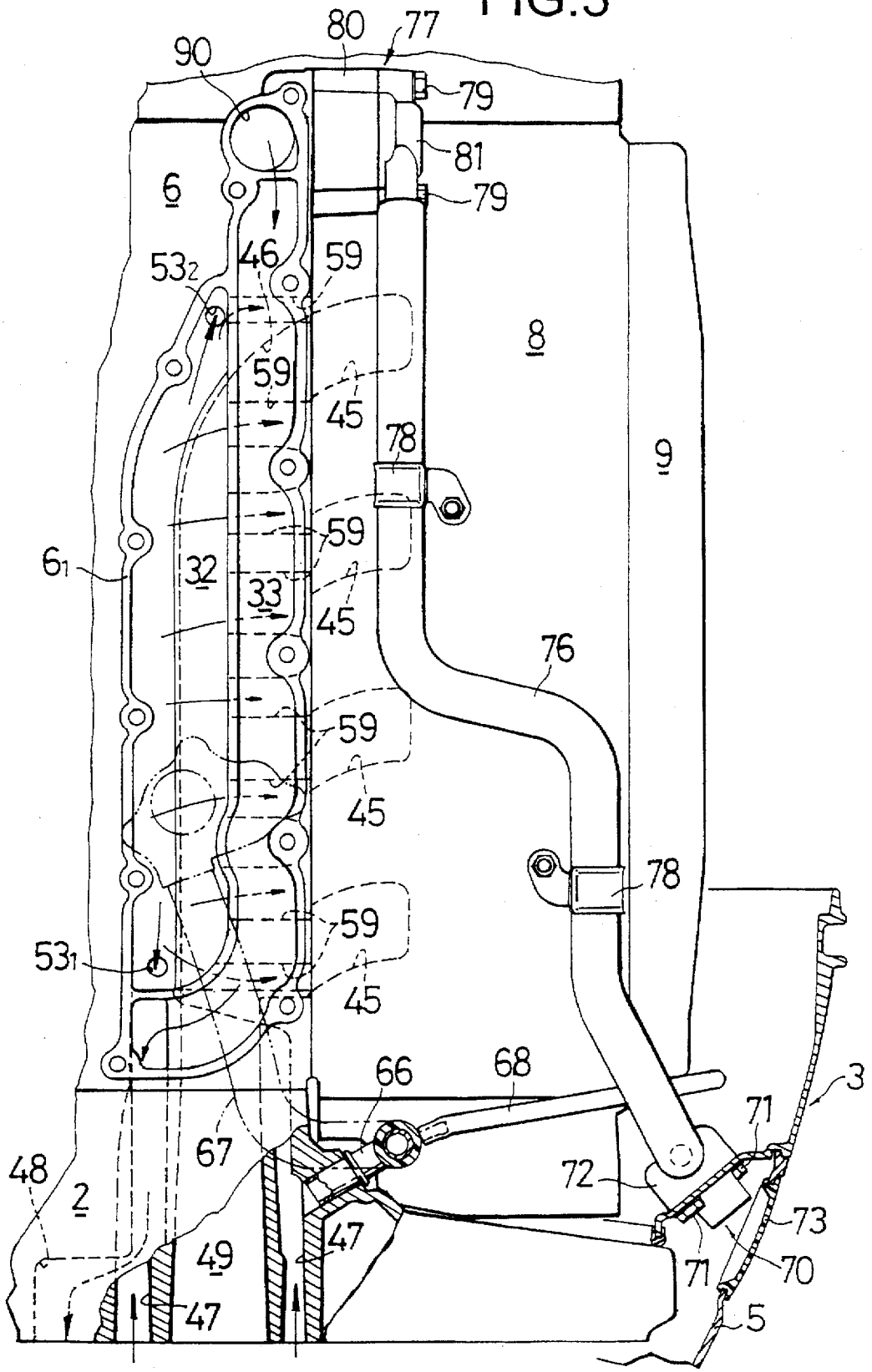
FIG. 3 is an enlarged view of an essential portion shown in FIG. 2.

FIG. 3 shows the engine with the cooling-water passage cover 34 removed from the cylinder block 6. The cooling-water dispensing chamber 32 and the cooling-water discharging passage 33 which extend vertically are formed parallel to each other inside the protrusion $\mathbf{6}_1$ defining a split face of the cylinder block 6. The exhaust passage 46 is formed in the protrusion $\mathbf{6}_1$ of the cylinder block 6 so as to be parallel to the cooling-water dispensing chamber 32 and the cooling-water discharging passage 33, and is connected to downstream portions of four exhaust ports 45 formed in the cylinder head 8.

Figure 4:
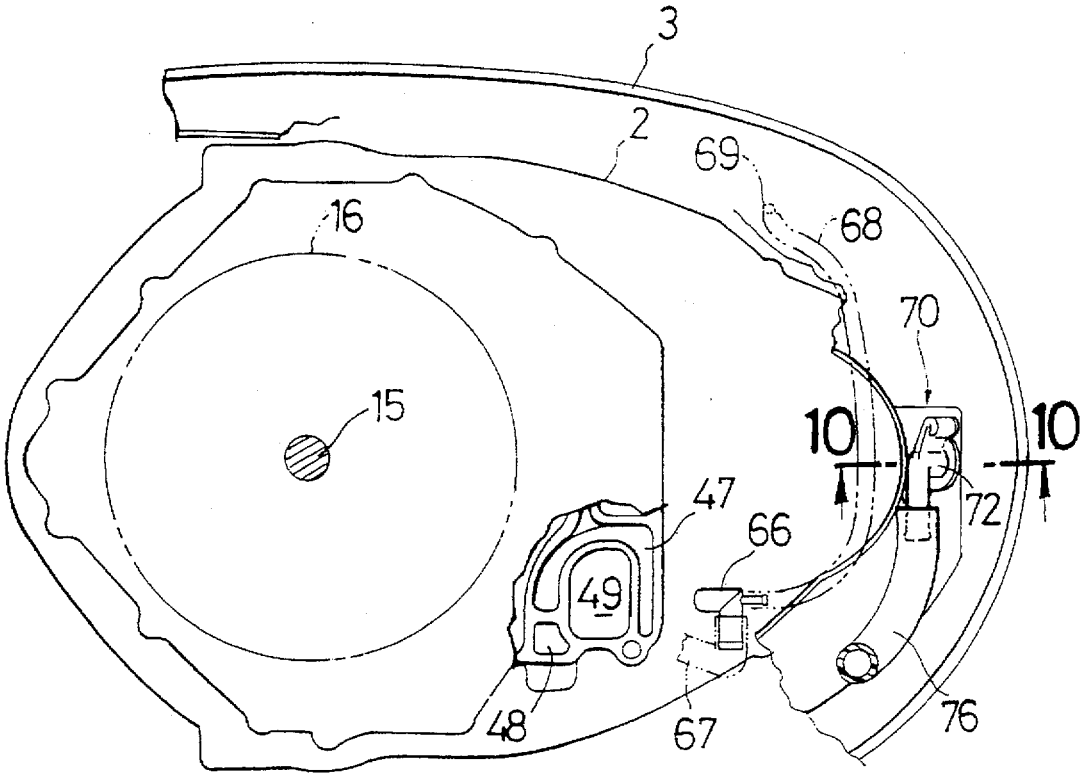
FIG. 4 is an enlarged view taken along a line 4—4 in FIG. 2.

As can be seen from FIG. 4, a cooling-water supply passage 47, a cooling-water discharging passage 48 and an exhaust passage 49 are connected to the cooling-water dispensing chamber 32, the cooling-water discharging passage 33 and the exhaust passage 46 and vertically extend through the mount case 2 which is coupled to the lower surface of the cylinder block 6. Thus, cooling water pumped by the cooling-water pump 31 is supplied to a lower end of the cooling-water dispensing chamber 32 in the cylinder block 6 through the cooling-water supply passage 47 in the mount case 2 to which an upper end of the cooling-water supply pipe 30 is connected. The cooling water from the cooling-water discharging passage 33 in the cylinder block 6 passes through the cooling-water discharging passage 48 in the mount case 2 and further through punched holes $\mathbf{50}_1$ in a gasket $\mathbf{50}_1$ (see FIG. 2) clamped between the mount case 2 and the extension case 1 and is discharged into an internal space 89 in the extension case 1. During this time, the mist of the cooling water passed through the punched holes $\mathbf{50}_1$ can be brought into contact with an oil pan 88 mounted on the lower surface of the mount case 2, so that the mist can be cooled to inhibit the rising of the temperature of the oil.

As can be seen from FIGS. 3 and 5, the cooling-water dispensing chamber 32 in the cylinder block 6 communicates with a first water jacket 52 formed around an outer periphery of the cylinders 12 through two vertically-disposed through-holes $\mathbf{53}_1$ and $\mathbf{53}_2$. In this manner, the cooling water is supplied from the cooling-water dispensing chamber 32 to the first water jacket 52. The lower through-hole $\mathbf{53}_1$ is near the cooling-water supply passage 47 in the mount case 2, and the upper through-hole $\mathbf{53}_2$ is far from the cooling-water supply passage 47 in the mount case 2. The cooling-water dispensing chamber 32 and the first water jacket 52 are disposed to surround three sides of the exhaust passage 46, thereby effectively cooling that area in the vicinity of the exhaust passage 46 which is at a high temperature.

Figure 7:
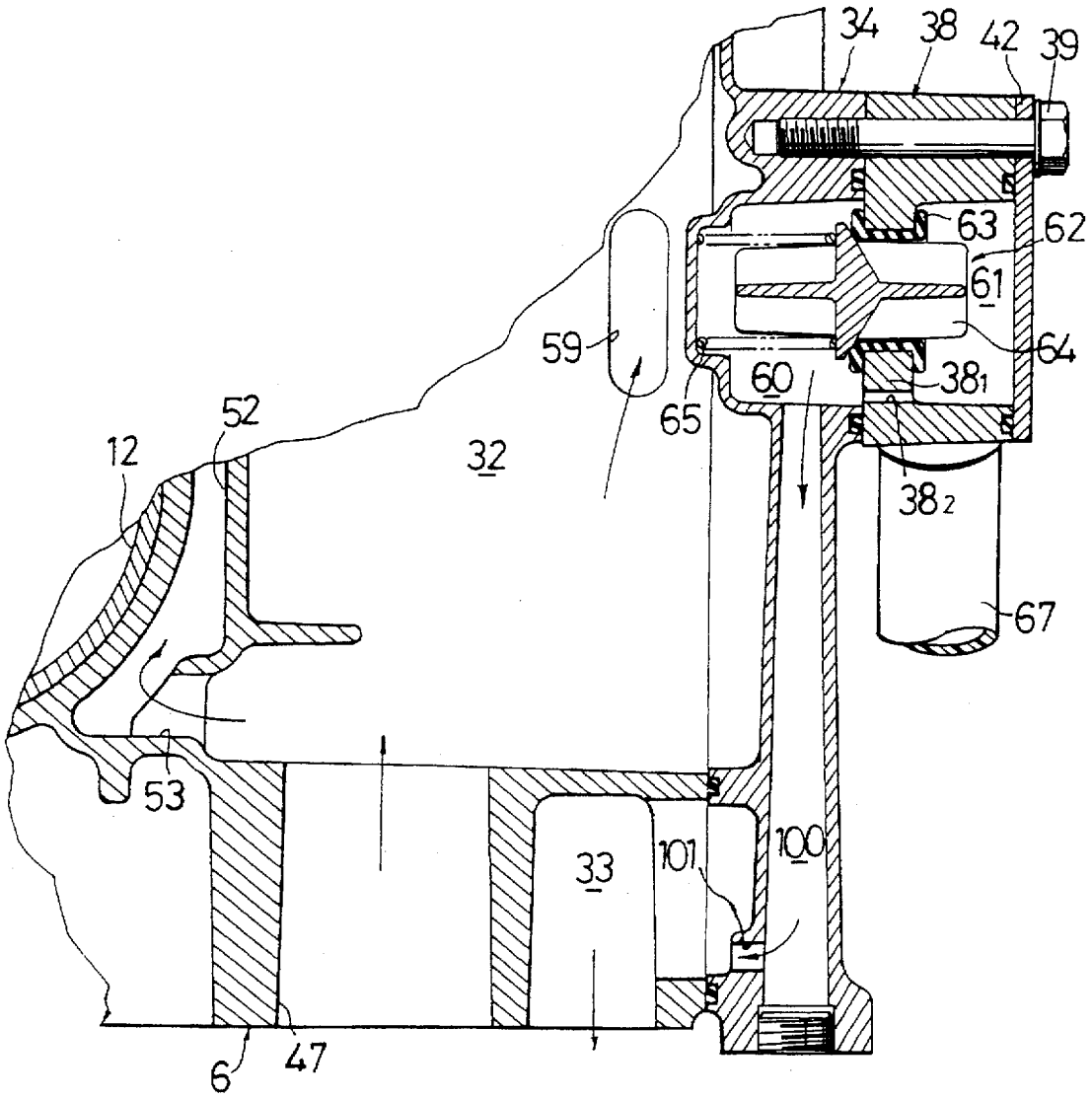
FIG. 7 is an enlarged sectional view taken along a line 7—7 in FIG. 2.
Figure 8:
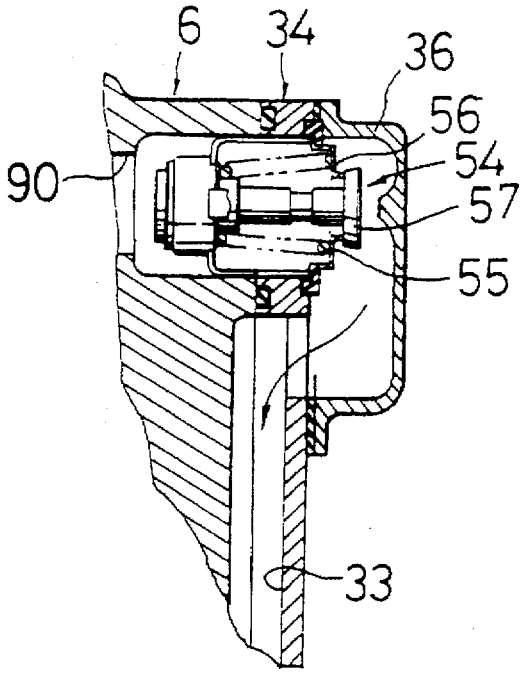
FIG. 8 is an enlarged sectional view taken along a line 8—8 in FIG. 2.

As can be seen from FIG. 8, the first water jacket 52 (FIGS. 5 and 7) formed around the outer periphery of the cylinders 12 extends at an upper end of the cylinder block 6. A thermo-valve 54 is mounted to the upper end of the cylinder block 6 and covered with the cooling-water passage cover 34 and the thermo-valve cover 36. The thermo-valve 54 includes a valve member 57 which is biased by a valve spring 55 in a direction to be seated on a valve seat 56. A second water jacket 58 is formed in the cylinder head 8 and joins the first water jacket 52 at a junction 51 (see FIG. 12) which is provided at a portion of the first water jacket 52 upstream of the thermo-valve 54.

A short cooling-water discharging passage 90 is formed in the cylinder block 6 and extends from the junction 51 to the thermo-valve 54 (see FIGS. 3, 8, 9 and 12). More specifically, the thermo-valve 54 is disposed between the upstream cooling-water discharging passage 90 and the downstream cooling-water discharging passage 33. A one-way valve 84 is connected to an upstream portion of the cooling-water discharging passage 90.

Figure 6:
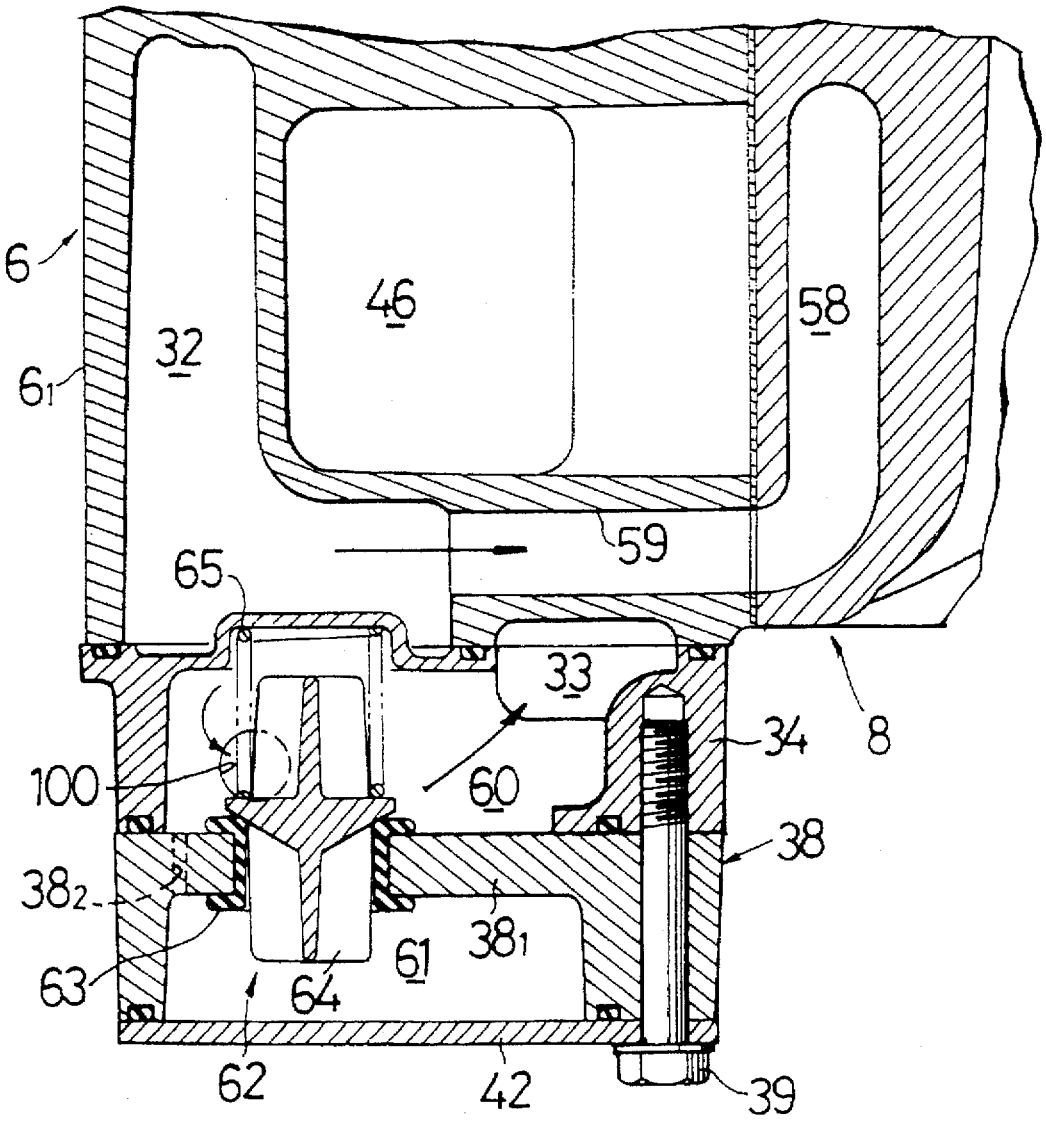
FIG. 6 is an enlarged sectional view taken along a line 6—6 in FIG. 2.

As can be seen from FIGS. 3 and 6, the second water jacket 58 formed in the cylinder head 8 communicates with the cooling-water dispensing chamber 32 formed in the cylinder block 6 through a plurality of (five on a packing face in the embodiment) through-holes 59 which are vertically juxtaposed and open into the packing face. In this manner, the cooling water is supplied from the cooling-water dispensing chamber 32 to the second water jacket 58. The cooling-water dispensing chamber 32 and the second water jacket 58 are disposed to surround three sides of the exhaust passage 46, thereby effectively cooling that area in the vicinity of the exhaust passage 46 which is at a high temperature.

As can be seen from FIGS. 6 and 7, a rear chamber 60 formed in the cooling-water passage cover 34 and a front chamber 61 formed in the relief valve housing 38 are partitioned from each other by a partition wall $\mathbf{38}_1$. The relief valve 62 is adapted to permit the cooling water to be diverted from the front chamber 61 to the rear chamber 60. The relief valve 62 includes a valve seat 63 provided on the partition wall $38_1$, a valve member 64 capable of being seated on the valve seat 63, and a valve spring 65 for biasing the valve member 64 toward the valve seat 63. A water-withdrawing hole $38_2$ having a small diameter is provided in the partition wall $38_1$ for permitting the communication between locations of the front and rear chambers 61 and 60 which are lowermost and nearest the tilting shaft 28.

As shown in FIGS. 2 and 3, a coupling 66 is mounted in the mount case 2 and communicates with the cooling-water supply passage 47. The coupling 66 and the front chamber 61 of the relief valve 62 are connected to each other by a hose 67. A water-examining tube 68 is connected to the coupling 66 and also to a water-examining outlet 69 (see FIG. 4) which is provided in a right side of the under-case 3. The hose 67 and the front and rear chambers 61 and 60 constitute a bypass passage which connects the cooling-water supply passage 47 and the cooling-water discharging passage 33 to each other.

As shown in FIGS. 2 and 7, a water-withdrawing passage 100 is formed in the cooling-water passage cover 34 and extends downwardly from the rear chamber 60 of the relief valve 62. A lower end of the water-withdrawing passage 100 communicates with the cooling-water discharge passage 33 through a through-hole 101.

A system for washing the water jacket will be described below with reference to FIGS. 2 to 4 and 9 to 11.

Figure 10:
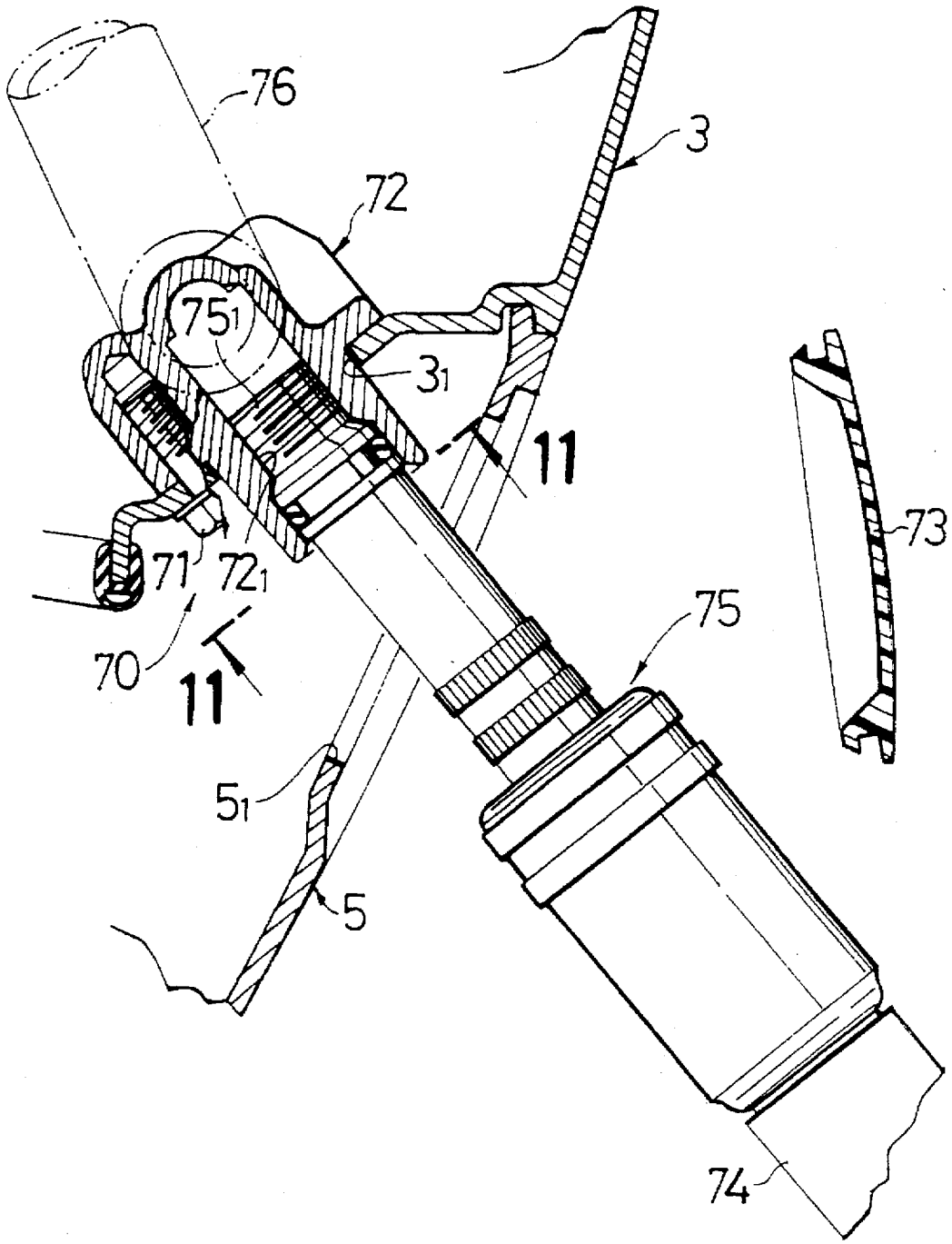
FIG. 10 is an enlarged sectional view taken along a line 10—10 in FIG. 4.
Figure 11:
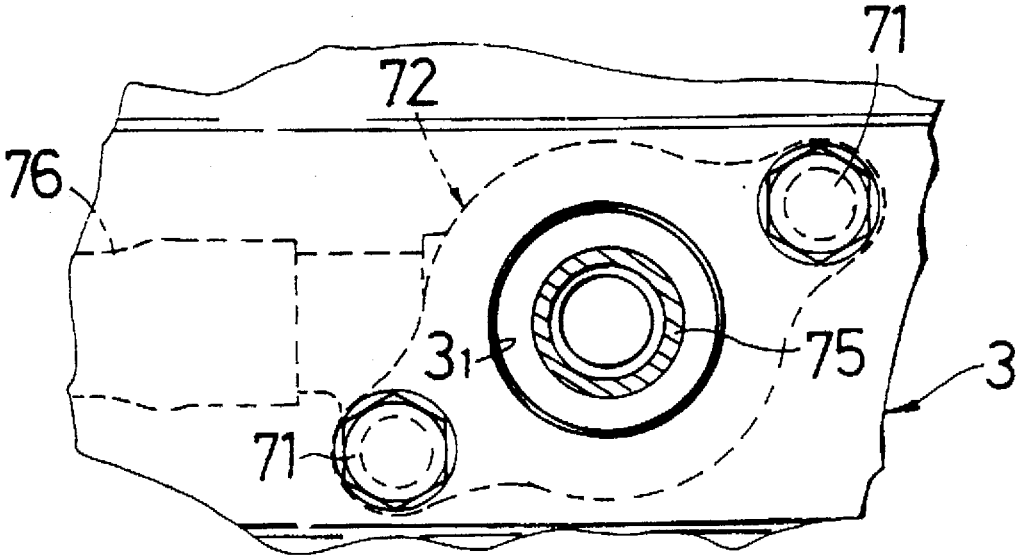
FIG. 11 is a view taken along a line 11—11 in FIG. 10.

As can be seen from FIGS. 10 and 11, a wash water supply section 70 provided on a rear wall surface of the under-case 3 covered with the under-cover 5 includes a connector 72 which is fitted into an opening $3_1$ of the under-case 3 and fixed by two bolts 71, 71. An opening $5_1$ is formed in the under-cover 5 located on a production or an extension of an axis of an internal thread $72_1$ provided in the connector 72. The opening $5_1$ is opened and closed by a removable lid 73 made of rubber. In this manner, an external thread $75_1$ provided at a tip end of the connector 72 connected to a tap water hose 74 can be threadedly engaged with the internal thread $72_1$ of the connector 72 by removing the lid 73.

As can be seen from FIG. 3, a wash water supply pipe 76 connected at its lower end to the connector 72 of the under-case 3 extends upwardly along a left side of the cylinder head 8 and is connected to a wash water introducing section 77 provided at the upper end of the cylinder block 6. The wash water supply pipe 76 is fixed at its intermediate portion to the left side of the cylinder head 8.

Figure 9:
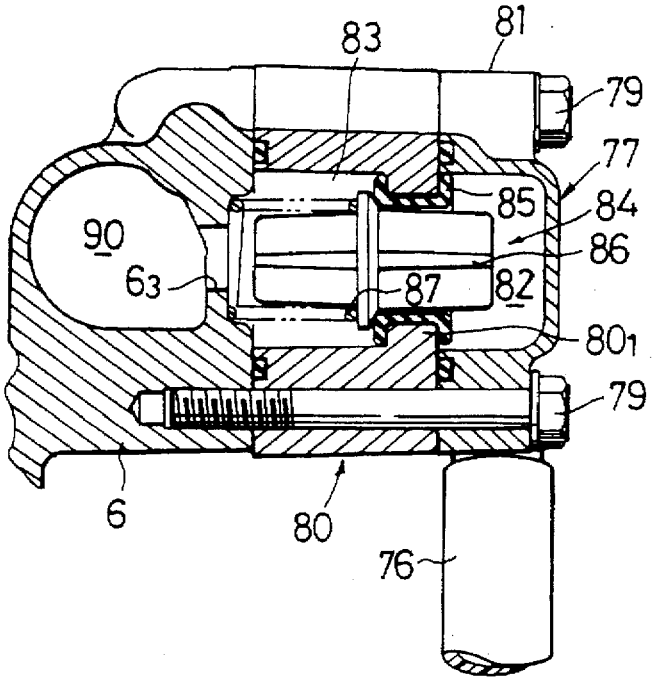
FIG. 9 is an enlarged sectional view of an essential portion shown in FIG. 3.

As can be seen from FIG. 9, the wash water introducing section 77 provided at a ridge protruding rearwardly from the cylinder block 6 includes a one-way valve housing 80 and a one-way valve cover 81 which are commonly clamped to a wall surface of the cylinder block 6 by two bolts. A front chamber 82 formed in the one-way valve cover 81 and a rear chamber 83 formed in the one-way valve housing 80 are partitioned from each other by a partition wall $80_1$. A one-way valve 84 for supplying the wash water from the front chamber 82 to the rear chamber 83 includes a valve seat 85 provided on the partition wall $80_1$, a valve member 86 capable of being seated on the valve seat 85, and a valve spring 87 for biasing the valve member 86 toward the valve seat 85.

The rear chamber 83 of the one-way valve 84 communicates through a through-hole $6_3$ with the cooling-water discharge passage 90 connected to downstream portions of the first and second water jackets 52 and 58. The through-hole $6_3$ is provided immediately upstream of the thermo-valve 54 in the cooling-water discharge passage 90.

Figure 12:
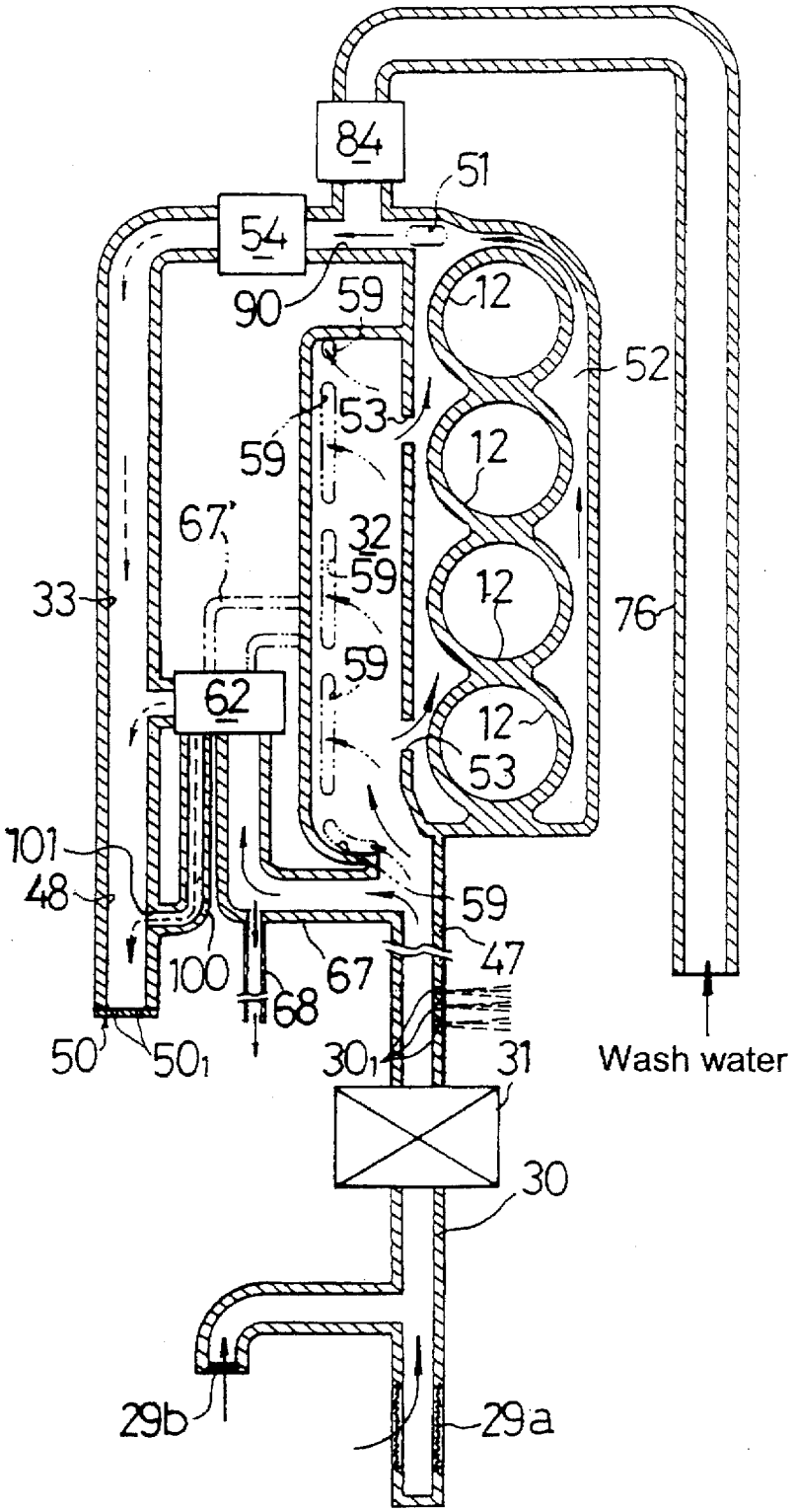
FIG. 12 is a diagrammatic illustration of a cooling-water flow path.

The operation of the embodiment of the present invention will be described below mainly with reference to FIG. 12.

When the engine temperature is low immediately after the start of the engine, the thermo-valve 54 is closed to inhibit a flowing of the cooling water from the first water jacket 52 in the cylinder block 6, the second water jacket 58 (see FIG. 6) in the cylinder head 8 and the cooling-water discharge passage 90 to the cooling-water discharge passage 33, thereby helping to warm the engine E. At this time, when the pressure of the cooling water in the cooling-water supply passage 47 increases as a result of the closing of the thermo-valve 54, the relief valve 62 is opened, whereby the cooling water in the cooling-water supply passage 47 is permitted to flow via the coupling 66, the hose 67, the front chamber 6 and a gap between the valve seat 63 and the valve member 64 of the relief valve 62 to reach the rear chamber 60. Consequently, a portion of the cooling water is discharged from the rear chamber 60 directly into the cooling-water discharge passage 33, and the remaining cooling water is discharged from the rear chamber 60 via the water-withdrawing passage 100 and the through-hole 101 into the cooling-water discharge passage 33.

When the warming has been completed, the thermo-valve 54 is automatically opened by rising of the temperature of the cooling water. When the pressure of the cooling water in the cooling-water supply passage 47 drops as a result of the opening of the thermo-valve 54, the relief valve 62 is closed. Thus, the cooling water pumped by the cooling-water pump 31 is permitted to flow from the cooling-water supply passage 47 into the cooling-water dispensing chamber 32 in the cylinder block 6 and then to flow via the two vertically disposed through-holes $53_1$ and $53_2$ into the first water jacket 52 in the cylinder block 6 and also via the plurality of vertically disposed through-holes 59 into the second water jacket 58 in the cylinder head 8. The cooling water which has cooled the second water jacket 58 flows through the junction 51 to join the cooling water which has cooled the first water jacket 52, and is discharged via the cooling-water discharge passage 90, the thermo-valve 54, the cooling-water discharge passage 33 and the cooling-water discharge passage 48 in the mount case 2 into the extension case 1.

When the cooling-water pump 31 is in operation to pump the cooling water, a portion of the cooling water in the cooling-water supply passage 47 is discharged from the water-examining outlet 69 via the coupling 66 and the water-examining tube 68. In this manner, the operational state of the cooling-water pump 31 can be confirmed based on the state of cooling water discharged. If the outboard engine system O is used in the sea, sea-water serving as cooling water is passed through the water jackets 52 and 58 and for this reason, it is necessary to wash the water jackets 52 and 58 with fresh water for the purpose of corrosion prevention. To wash the water jackets 52 and 58, the lid 93 is removed from the opening $5_1$ of the under-cover 5 to expose the wash water supply section 70. The external thread $75_1$ of the connector 75 mounted at the tip end of the tap water hose 74 is screwed into the thread $72_1$ of the connector 72 of the wash water supply section 70.

The spring force for biasing the thermo-valve 54 in a closing direction at a cold temperature (namely, the pressure for opening the thermo-valve 54) is set in accordance with a pressure discharged from the cooling-water pump 31 and a required flow rate during opening of the thermo-valve 54. Specifically, the pressure for opening the thermo-valve 54 is set at a valve higher than the pressure discharged from the cooling-water pump 31, so that the thermo-valve 54 is little opened even by a discharged pressure under a relatively high revolution-number of the cooling-water pump 31 comprised of a vane pump. To relieve the pressure in the closed state of the thermo-valve 54, the pressure for opening the relief valve 62 is set at a level lower than the pressure for opening the thermo-valve 54.

The pressure of the wash water supplied from the tap water hose 74 is varied depending upon conditions, but is lower than the pressure for opening the thermo-valve 54 and higher than the pressure for opening the relief valve 62. The pressure for opening the one-way valve 84 is set at an extremely low level, so that the one-way valve 84 is reliably opened even by the pressure of tap water.

Therefore, the one-way valve 84 is opened by the pressure of the wash water supplied from the tap water hose 74 through the wash water supply section 70, the wash water supply pipe 76 and the wash water introducing section 77. The wash water flows into the cooling-water discharge passage 90. When the pressure of the wash water is applied to the cooling-water discharge passage 90, the thermo-valve 54 is not opened by such pressure, but the relief valve 62 is opened, because the cooling-water supply pipe 30 has been substantially closed by the cooling-water pump 31. As a result, the wash water flows from the wash water introducing section 67 upstream through the first water jacket 52 in the cylinder block 6, the second water jacket 58 in the cylinder head 8, the cooling-water dispensing chamber 32, the hose 67 and the relief valve 62 to wash them, and is then discharged via cooling-water discharge passage 33.

The wash water passed through the first and second water jackets 52 and 58 is discharged through the relief valve 62, as described above. Therefore, even if the thermo-valve 54 is forcedly not opened by the water pressure, a sufficient amount of the wash water larger than an amount of water leaked can be supplied in a relatively short time into the first and second water jackets 52 and 58. Thus, it is easy to wash even with tap water.

During operation of the outboard engine system, the one-way valve 84 is closed by the pressure of the cooling water and hence, the cooling water cannot be leaked through the one-way valve 84.

In addition, since the cooling-water supply section provided in the under-case 3 is covered with the under-cover 5 and the lid 73 mounted on the under-cover 5 is opposed to the cooling-water supply section 70, the water jackets 52 and 58 can be washed by removing only the lid 73 in place of removal of the large-sized engine cover 4, leading to an enhanced workability. Additionally, the cooling-water supply section 70 cannot be viewed from the outside, leading to an enhanced appearance.

If the pressure of the cooling water in the cooling-water supply passage 47 is increased during operation of the engine E at a high speed, both of the thermo-valve and the relief valve 62 are opened. When the thermo-valve 54 is in its semi-opened state during warming operation of the engine E, the pressure of the cooling water in the cooling-water supply passage 47 is increased whereby the relief valve 62 is likewise opened. When both of the thermo-valve 54 and the relief valve 62 have been opened in this manner, on the assumption that the intermediate portion of the cooling-water dispensing chamber 32 and the relief valve are connected to each other by a bypass passage 67' as shown by a dashed line in FIG. 12, all the amount of the cooling water flows through that lower half of the cooling-water dispensing chamber 32 which is located adjacent the cooling-water supply passage 47. At such a time, the amount of the cooling water diverted to the relief valve 62 does not flow through that upper half of the cooling-water dispensing chamber 32 which is located downstream of the junction with the bypass passage 67', resulting in a decreased flow rate of the cooling water. For this reason, the amount of the cooling water flowing through the lower half of the cooling-water dispensing chamber 32 is larger, and the amount of the cooling water flowing through the upper half of the cooling-water dispensing chamber 32 is smaller. Consequently, the flow rate of cooling water within the cooling-water dispensing chamber 32 is partially unbalanced.

As a result, both of the amount of the cooling water passed through the two through-holes $53_1$ and $53_2$ connected to the first water jacket 52 in the cylinder block 6 and the amount of the cooling water passed through the plurality of (five on the packing face in the embodiment) through-holes 59 connected to the second water jacket 58 in the cylinder head 8 are unbalanced. Therefore, it is difficult to uniformly cool the cylinder block 6 and the cylinder head 8 and particularly to cool the wall surface $6_2$ (see FIG. 5) which is in contact with the exhaust passage 46.

According to the present invention, however, the hose 67 connected to the relief valve 62 diverges from the cooling-water supply passage 47 upstream of the cooling-water dispensing chamber 32. Accordingly, even if the relief valve 62 is opened, the amount of the cooling water flowing within the cooling-water dispensing chamber 32 is only decreased all over. Therefore, the amount of the cooling water flowing within the lower half of the cooling-water dispensing chamber 32 and the amount of the cooling water flowing within the upper half of the cooling-water dispensing chamber 32 are not unbalanced, and thus, it is possible to uniformly cool the cylinder block 6 and the cylinder head 8.

When the thermo-valve 54 has been closed, the cooling water retained within the first and second water jackets 52 and 58 cannot be discharged through the relief valve 62. Consequently, the temperature of the cooling water within the first and second water jackets 52 and 58 can be promptly increased to complete the warming in a short time.

The water-withdrawing passage 100 connected to the rear chamber 60 of the relief valve 62 opens into the rear chamber 60 at a location which is lower and nearer the tilting shaft 28 than the cooling-water discharged passage 33, as shown in FIG. 6. The shape of the rear chamber 60 is determined so that such an opening of the water-withdrawing passage 100 is maintained at the lowermost location in the rear chamber 60, even if the outboard engine system O is slightly tilted up. Therefore, the water left in the rear chamber 60 of the relief valve 62 is discharged via the water-withdrawing passage 100, the through-hole 101 and the cooling-water discharge passages 33 and 48, as shown in FIG. 7.

Water left in the front chamber 61 of the relief valve 62 is discharged some of the time via the hose 67, the coupling 66, the cooling-water supply passage 47, the cooling-water supply pipe 30 and a clearance of the cooling-water pump 31. However, in a condition in which the outboard engine system O has been tilted up, a small amount of water may be left in a lower portion of the front chamber 61 in some cases. But even if the water is left in the lower portion of the front chamber 61 in this manner in the tilted-up state of the outboard engine system O, such water flows through the water-withdrawing hole $38_2$ formed in the partition wall $38_1$ into the rear chamber 60 and is then discharged from the rear chamber 60 via the water-withdrawing passage 100.

Figure 13:
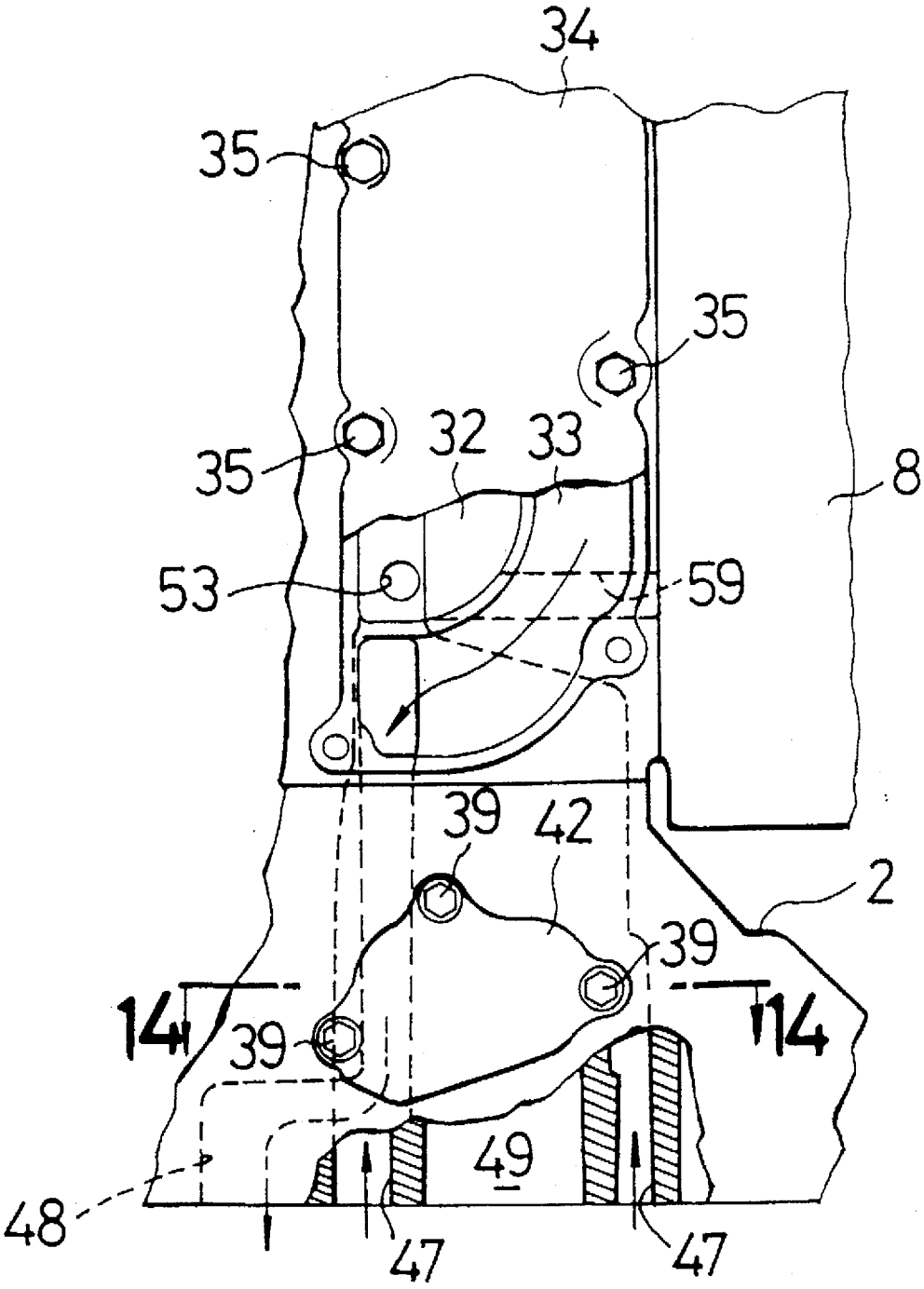
FIG. 13 is a view similar to FIG. 3, but according to a second embodiment of the present invention.

A second embodiment of the present invention will now be described with reference to FIGS. 13 and 14.

In the previously-described first embodiment, the relief valve 62 is mounted in the cylinder block 6, and in the second embodiment, a relief valve of the same structure is mounted in the mount case 2. Specifically, a cooling-water supply passage 47 and a cooling-water discharge passage 48 vertically extend through the mount case 2 to surround the exhaust passage 46. The relief valve 62 diverts cooling water from the cooling-water supply passage 47 directly into the cooling-water discharge passage 48. If the second embodiment is compared with the first embodiment, the cooling-water discharge passage 48 in the second embodiment is located nearer the tilting shaft 28. A relief valve housing 38 and a relief valve cover 42 are fixed to the left side of the mount case 2 by three bolts 39. A front chamber 61 provided in the relief valve housing 38 and a rear chamber 60 provided in the mount case 2 communicate with each other through the relief valve 62.

The front chamber 61 communicates with the cooing-water supply passage 47 through a through-hole 102 which constitutes a portion of the bypass passage. The rear chamber 60 communicates with the cooling-water discharge passage 48 through a through-hole 103 which constitutes a portion of the bypass passage. Since the cooling-water discharge passage 48 is at the location nearer the tilting shaft 28 as described above, the through-hole 72 connecting the front chamber 61 and the cooling-water discharge passage 48 to each other is formed at a location on the opposite side of the cooling-water discharge passage 48 from the tilting shaft 28 (on the right side in FIG. 14). Further, the front and rear chambers 61 and 60 communicate with each other through the water-withdrawing hole $38_2$ having the small diameter. The rear chamber 60 is provided with the water-withdrawing hole 100 which extends downwardly through the mount case 2 and opens into the extension case 1. In consideration of the withdrawal of the water in the tilted-up state of the outboard engine system, the water-withdrawing holes $38_2$ and 100 are formed in the front and rear chambers 61 and 60 at locations nearest to the tilting shaft 28 (on the left side in FIG. 14). Most or all of the through-holes 102 and 103 and the water-withdrawing holes $38_2$ and 100 can be shaped by molding, thereby enabling a reduction in number of producing steps.

Figure 14:
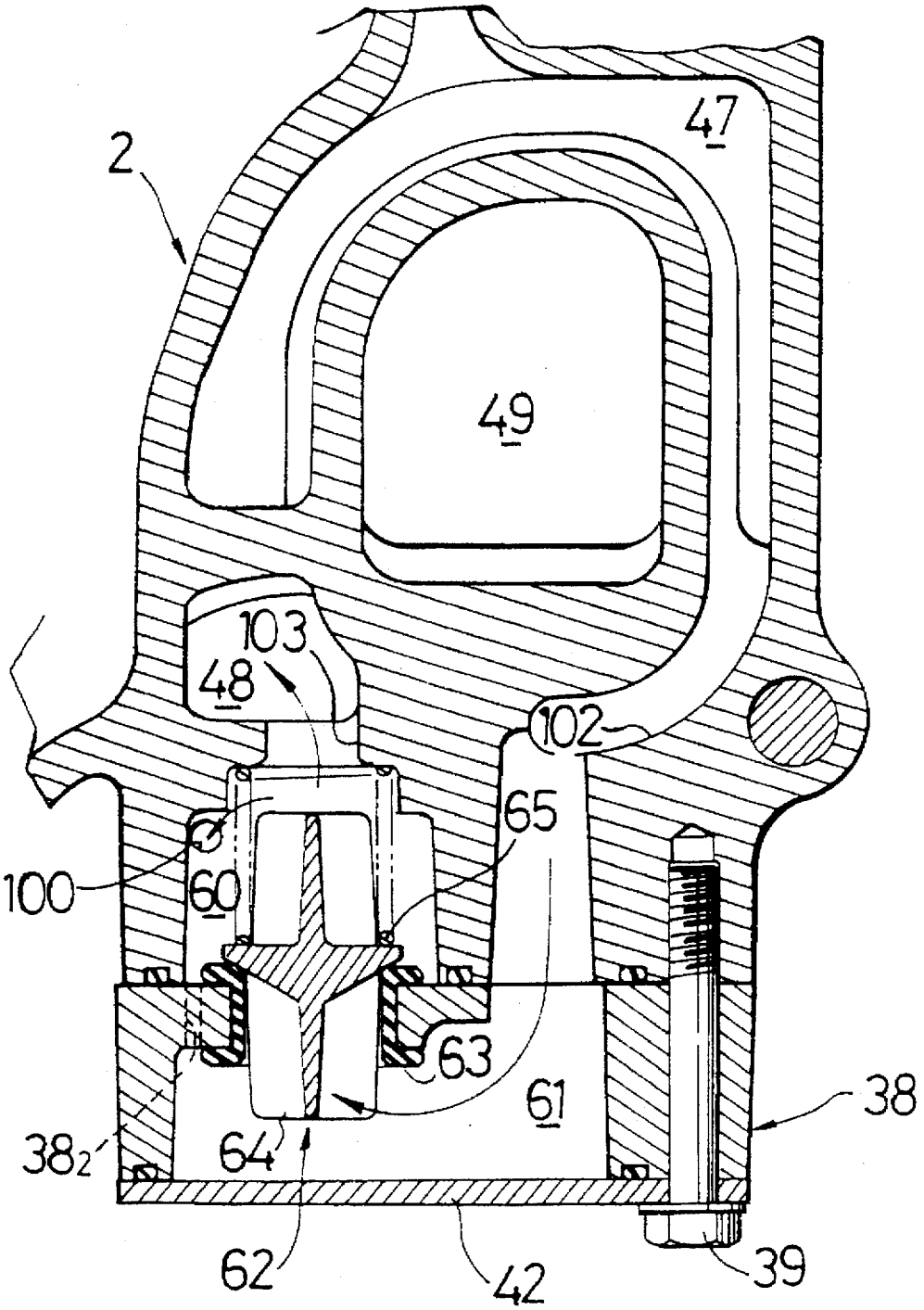
FIG. 14 is a sectional view taken along a line 14—14 in FIG. 13.

As apparent from the comparison of FIGS. 6 and 14 with each other, the cooling-water discharge passage 48 in the second embodiment extends through a location near the relief valve 62, as compared with the cooling-water discharge passage 33 in the first embodiment and hence, the volume of the rear chamber 60 can be reduced. Additionally, in the second embodiment, the hose 67 used in the first embodiment is not required, and the through-hole 102 permitting the communication between the cooling-water supply passage 47 and the front chamber 61 need only be formed Thus, it is possible to reduce the number of parts or components and to simplify the structure.

Figure 15:
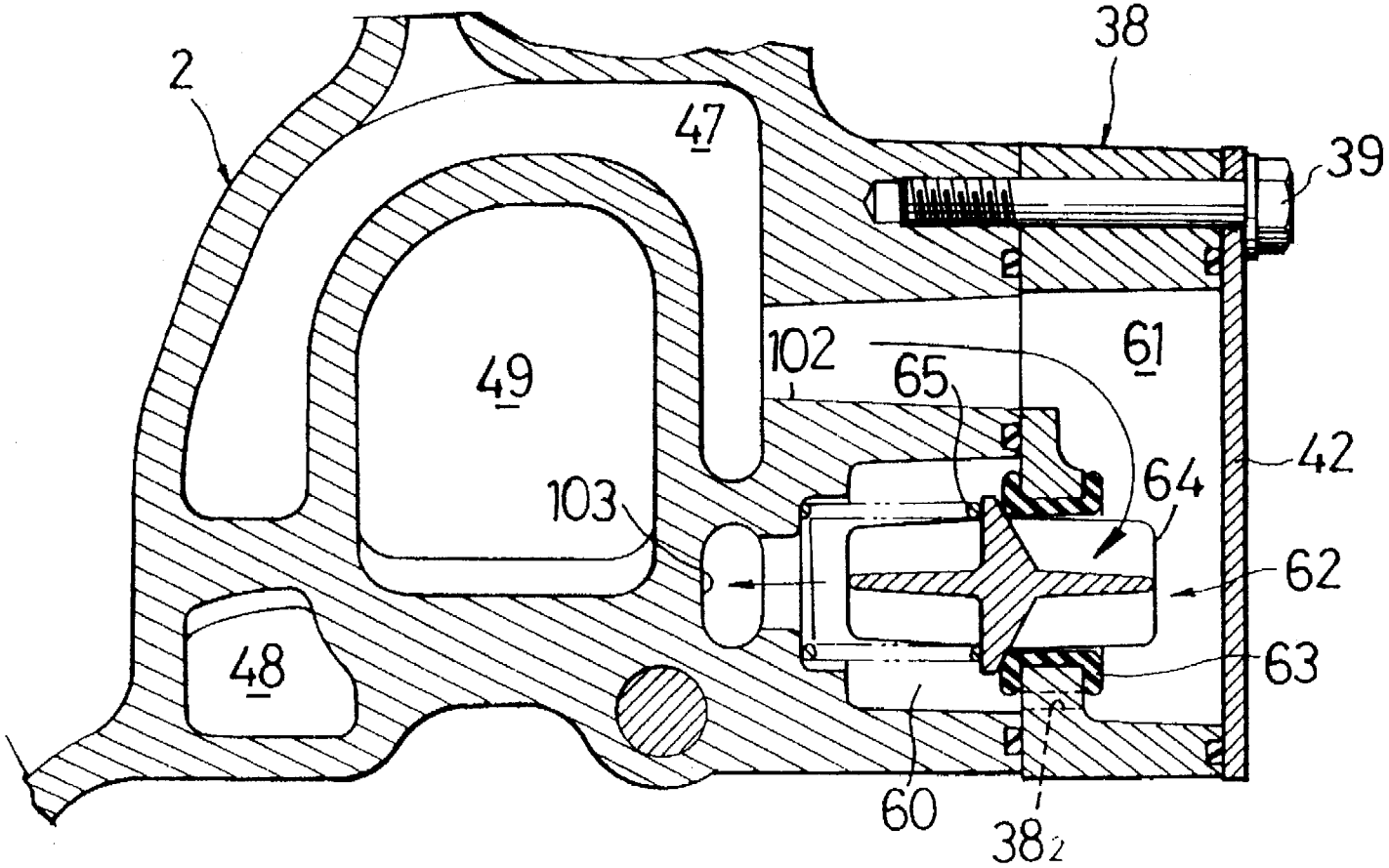
FIG. 15 is a view similar to FIG. 14, but according to a third embodiment of the present invention.

A third embodiment of the present invention will now be described with reference to FIG. 15.

Even in the third embodiment, a relief valve 62 is mounted in the mount case 2, as in the second embodiment, but is located in the rear surface rather than the left side of the mount case 2. The front chamber 61 communicates with the cooling-water supply passage 47 in the mount case 2 through the through-hole 102 which constitutes a portion of the bypass passage, as in the second embodiment. The hose 67 used in the first embodiment is omitted. The rear chamber 60 does not communicate with the cooling-water discharge passage 48, but extends vertically through the mount case 2 and communicates with the through-hole 73 which constitutes a portion of the bypass passage. The rear chamber 60 is formed at a location nearer the tilting shaft 28 than the rear chamber 60 (on the left side in FIG. 15) and hence, in a tilted-up state of the outboard engine system O, the discharging of the cooling water is further reliably performed.

A fourth embodiment of the present invention will now be described with reference to FIG. 16.

Figure 16:
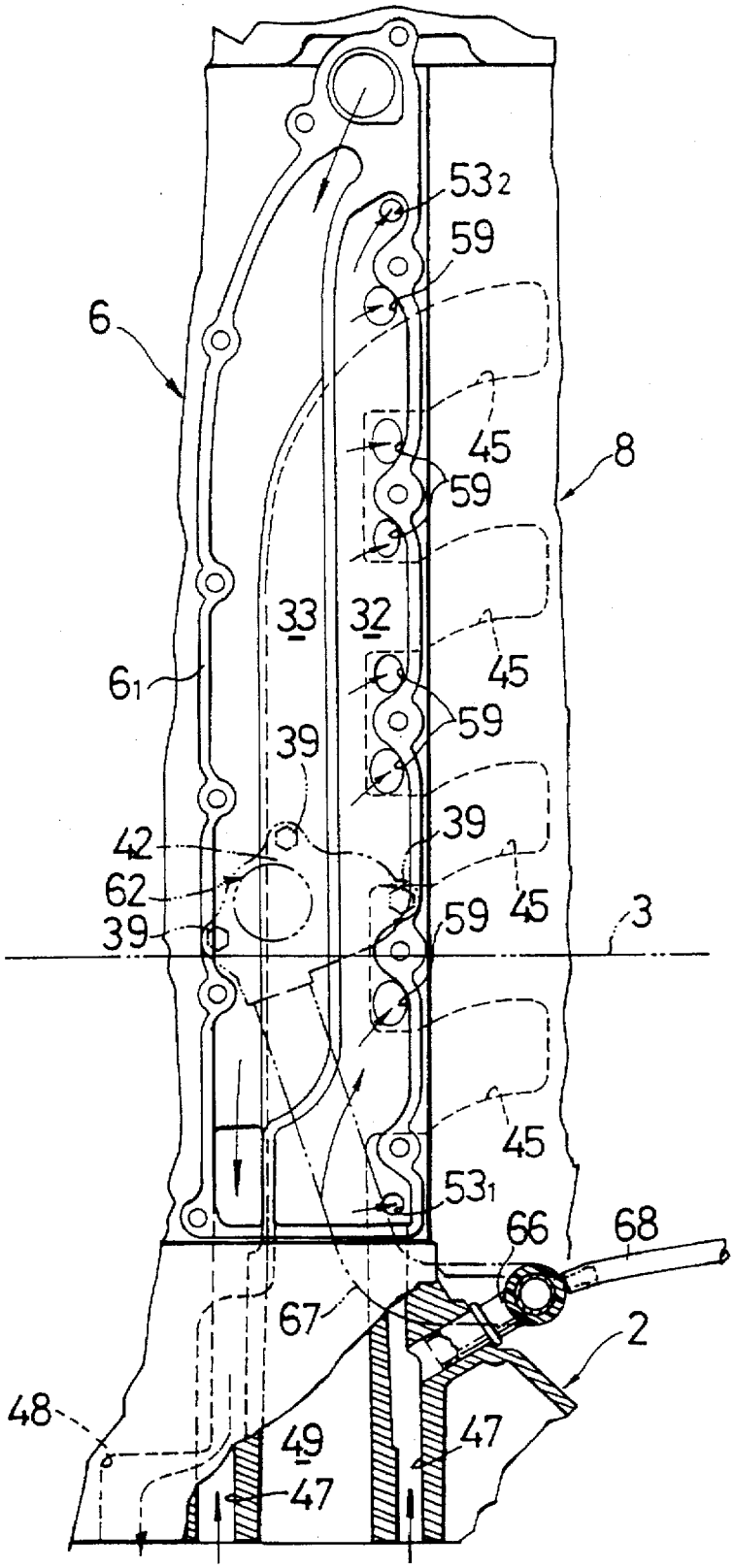
FIG. 16 is a view similar to FIG. 3, but according to a fourth embodiment of the present invention.

As can be seen from the comparison of FIG. 3 illustrating the first embodiment with FIG. 16 illustrating the fourth embodiment, the cooling-water discharge passage 33 in the fourth embodiment is provided at a position more forward (nearer the tilting shaft 28) than the cooling-water dispensing chamber 32. In other words, the longitudinal positional relationship between the cooling-water discharge passage 33 and the cooling-water dispensing chamber 32 formed in the protrusion $6_1$ of the cylinder block 6 in the fourth embodiment is reversed from that in the first embodiment. The cooling-water discharge passage 33 and the cooling-water dispensing chamber 32 are covered with the cooling-water passage cover 34 (not shown). The positional relationship between the cooling-water discharge passage 33 and the cooling-water dispensing chamber 32 ensures that the relief valve can be mounted in a layout similar to that in the second embodiment shown in FIG. 14.

More specifically, the rear chamber 60 connected to the cooling-water discharge passage 33 is formed directly in the protrusion $6_1$ of the cylinder block 6. The front chamber 61 is formed in the cooling-water passage cover 34 coupled to the protrusion $6_1$. The front chamber 61 is covered with the relief valve cover 42 which is fixed to the cooling-water passage cover 34 by the three bolts 39. The cooling-water supply passage 47 in the count case 2 and the front chamber 61 are connected to each other by the hose 67.

In the fourth embodiment, the relief valve housing 38 used in the first embodiment is not required, leading to a reduction in number of parts or components.

Although the embodiments of the present invention have been described in detail, it will be understood that the present invention is not limited to the above-described embodiments, and various modifications in design may be made without departing from the spirit and scope of the invention formed in claims.

For example, although the rear chamber 60 of the relief valve 62 communicates with the cooling-water discharge passage 33 in the cylinder block in the first embodiment, the rear chamber 60 may be formed to communicate with the cooling-water discharge passage 48 in the mount case 2. In addition, the one-way valve 84 is not necessarily required. For example, the cooling-water supply section 70 may be closed by a cock or a plug. When the washing is to be carried out, the cock may be opened, or the plug may be removed, and the tap water hose 74 may be then connected to the cooling-water supply section 70. In this case, in place of the one-way valve 84 which is not required, an operation of opening and closing the cock or an operation of mounting and removing the plug is required.

What is claimed is:

1. An engine for an outboard engine system, comprising:

a water jacket provided in an engine block;

a first cooling-water passage connected to said water jacket at a location upstream in a direction of flowing of the cooling water;

a second cooling-water passage connected to said water jacket at a location downstream in the direction of flowing of the cooling water;

a cooling-water pump for supplying the cooling water to said first cooling-water passage; and a thermo-valve mounted in said second cooling-water passage, said engine further including a bypass passage for connecting said first cooling-water passage to said second cooling-water passage at a location more downstream in the direction of flowing of the cooling water than said thermo-valve, a relief valve mounted in said bypass passage for permitting the cooling water to bypass from the said first cooling-water passage to said second cooling-water passage, and a wash water introducing section provided in said second cooling-water passage between said water jacket and said thermo-valve.

2. An engine for an outboard engine system according to claim 1, further including a one-way valve mounted in said wash water introducing section for limiting the flowing-out of the cooling water from said wash water introducing section.

3. An engine for an outboard engine system according to claim 1, wherein said wash water introducing section is provided in a ridge formed in said engine block.

4. An engine for an outboard engine system according to claim 1, further including a body case for supporting said engine on an upper surface of the body case; a lower case fixed to said body case to cover a lower half of said engine; an upper cover detachably fixed to an upper edge of said lower case to cover an upper half of said engine; a lower cover bolted to a lower edge of said lower case, and extended downwardly from said lower edge and connected to an outer surface of said body case; a wash water supply section provided in said lower case and covered with said lower cover; a wash water supply passage disposed within said upper cover and lower case and connecting said wash water supply section and said wash water introducing section to each other; and a lid which is capable of opening and closing, and mounted to said lower cover opposed to said wash water supply section.

5. An engine for an outboard engine system, said engine comprising:

a cylinder block;

a cylinder head;

an exhaust port provided in said cylinder head;

an exhaust passage provided in said cylinder head and connected to said exhaust port;

a first water jacket provided in said cylinder block;

a second water jacket provided in said cylinder head;

a cooling-water dispensing chamber for dispensing cooling water to said first and second water jackets through a plurality of through-holes;

a cooling-water supply passage for supplying the cooling water into said cooling-water dispensing chamber;

a cooling-water discharge passage into which the cooling water passed through said first and second water jackets flows;

a bypass passage means which is interposed between said cooling-water supply passage and said cooling-water discharge passage so as to bypass said cooling-water dispensing chamber;

a relief valve for opening and closing said bypass passage means; and a cooling-water passage cover that is mounted to said cylinder block and defines at least partially said cooling-water dispensing chamber and further defines at least partially said cooling-water discharge passage;

wherein said bypass passage means includes a first chamber interposed between said cooling-water supply passage and said cooling-water discharge passage, said first chamber being defined at least partially by said cooling-water passage cover and being open and closed by said relief valve for controlling connection and disconnection between said cooling-water supply passage and said cooling-water discharge passage.

6. The engine according to claim 5, further comprising a cover fixed to said cooling-water passage cover to define a second chamber therein that can be communicated with said first chamber.

* * * * *